US005393650A

United States Patent [19]

Bagchi et al.

[11] Patent Number: 5,393,650

[45] Date of Patent: Feb. 28, 1995

[54] PRESSURE SENSITIVITY RELIEF FOR PHOTOGRAPHIC PRODUCTS

[75] Inventors: Pranab Bagchi, Webster; Melvin M. Kestner, Hilton, both of N.Y.

[73] Assignee: Eastman Kodak Company, Rochester, N.Y.

[21] Appl. No.: 265,997

[22] Filed: Jun. 27, 1994

Related U.S. Application Data

[62] Division of Ser. No. 114,535, Aug. 31, 1993.

[51] Int. Cl.[6] ..... G03C 1/76

[52] U.S. Cl. ..... 430/523; 430/138; 430/531; 430/536; 430/545

[58] Field of Search ..... 430/138, 523, 531, 536, 430/545, 621, 627

[56] References Cited

U.S. PATENT DOCUMENTS 4,855,219 8/1989 Bagchi et al. .
4,920,004 4/1990 Bagchi .
5,013,640 5/1991 Bagchi et al. .
5,026,632 6/1991 Bagchi et al. .
5,066,572 11/1991 O'Connor et al. .

*Primary Examiner*—Jack P. Brammer
*Attorney, Agent, or Firm*—Robert A. Gerlach

[57] ABSTRACT

This invention describes the use of surfactants of the following types:

Type A—Surfactant comprising 6 to 22 carbon atom hydrophobic tail with one or more attached hydrophilic chains comprising at least 8 oxyethylene and/or glycidyl ether groups that may or may not be terminated with a negative charge such as a sulfate group.

Type B—Block oligomeric surfactants comprising hydrophobic polyoxypropylene blocks (A) and hydrophilic polyoxyethylene blocks (B) joined in the manner of A—B—A, B—A—B, A—B, $(A—B-_n{\equiv}G{\equiv}(B—A)_n$, or $(B—A)_n{\equiv}G(A—B)_n$, where G is a connective organic moiety and n is between 1 and 3.

Type C—Sugar surfactants, comprising between one to three 6 to 22 carbon atom hydrophobic tail with one or more attached hydrophilic mono or oligosaccharidic chains that may or may not be terminated by a negatively charged group such as a sulfate group.

in combination with gelatin-grafted-polymer particles to obtain aggregation and defect free photographic multilayer coatings that are considerably low in pressure sensitivity.

10 Claims, 4 Drawing Sheets

× = CH gel-g-latex in UV layer at 0.214 g/m$^2$

□ = CH gel-g-latex in UV layer at 0.428 g/m$^2$

△ = LUDOX™ in OVERCOAT

PRESSURE SENSITIVITY RELIEF FOR PHOTOGRAPHIC PRODUCTS

This is a divisional of application U.S. Ser. No. 114,535, filed Aug. 31, 1993, pending September 1994.

FIELD OF THE INVENTION

This invention relates to coating compositions of soft polymer particles in combination with certain types of long hydrophilic chain surface active agents to prepare coated layers of photographic elements less sensitive to mechanical pressure.

BACKGROUND OF THE INVENTION

U.S. Pat. No. 4,855,219 issued to Bagchi et al. and U.S. Pat. No. 4,920,004 issued to Bagchi described strongly adhering matte bead particles for photographic systems having a polymeric core covalently bonded to a gelatin shell. These particles are referred to as gelatin grafted polymer particles (gel-g polymer particles).

Soft polymer latex particles covalently bonded to gelatin particles, the preparation thereof and their use as materials that can be incorporated in photographic layers to reduce the pressure sensitivity of various photographic products are extensively described in U.S. Pat. Nos. 5,026,632 and 5,066,572. The particles are described as gelatin-grafted soft latex particles (gel-g soft latex particles) which when subjected to a subsequent crosslinking produces a soft core surrounded by a shell of cross-linked gelatin and referred to as case hardened gel-grafted soft latex particles (CH gel-g latex particles). Thus, the term gel-g particles refers to both described types of particles covalently bonded to a shell of gelatin.

Even though in many cases photographic layers comprising gel-g-latexes or case-hardened gel-g-latexes can be coated without any difficulty or product defects many times, defects due to aggregation or flocculation involving the gel-g-latexes or case-hardened gel-g-latex particle have been seen in fabricated photographic coatings. This is a serious disadvantage for the formulation of photographic products with layers comprising gel-g-latex or case-hardened gel-g-latexes.

PROBLEM TO BE SOLVED BY THE INVENTION

There is an urgent need to reduce coating defects arising out of flocculation of the gel-g-latexes or case-hardened gel-g-latexes that are coated in photographic layers to reduce the sensitivity of photographic products to mechanical stress or pressure.

SUMMARY OF THE INVENTION

An objective of this invention is to produce a photographic product with less pressure sensitivity comprising gelatin-grafted soft polymer particles that are free of defects arising out of the aggregation or flocculation of its composite particles.

Another objective of this invention is to produce a photographic coating compositions employing gelatin-grafted-soft polymer particles that are free of aggregates or flocculants of the said composite particles.

These and other objectives of this invention are achieved by adding a surfactant selected from the following three types of surfactants to a photographic coating composition comprising gel-g-soft latexes or case-hardened gel-g-soft latexes.

Type A—an amphiphilic surfactant comprising a 6 to 22 carbon atom hydrophobic tail with one or more attached hydrophilic chains comprising at least 8 oxyethylene and/or glycidyl ether groups that may or may not be terminated with a negative charge such as a sulfate group.

Type B—Block oligomeric surfactants comprising hydrophobic polyoxypropylene blocks (A) and hydrophilic polyoxyethylene blocks (B) joined in the manner of A—B—A, B—A—B, A—B, $(A—B_n)\equiv G\equiv(B—A)$, or $(B—A)_n\equiv G\equiv(A—B)_n$, where G is a connective organic moiety and n is between 1 and 3.

Type C—Sugar surfactants, comprising between one and three 6 to 22 carbon atom hydrophobic tail with one or more attached hydrophilic mono or oligosaccharidic chains that may or may not be terminated by a negatively charged group such as a sulfate group.

The total amount of any of the above surfactants or a suitable combination of the above surfactants may range between 5 percent and 30 percent based on weight of the core polymer particle in the gel-g-soft latex.

While applicant does not wish to be bound by any theory, it is postulated that the surfactants of this invention use their hydrophobic tails to attach to the hydrophobic segments of the chemically bonded gelatin molecules on the surface of the gel-g-soft latex or the case-hardened gel-g-soft latex particles and provide additional steric protection to coagulation or flocculation of these particles in a coating melt or during the high shear coating process. FIGS. 1*a* and 1*b* schematically depicts such a theoretical concept. FIG. 1*a* depicts the case for gel-g-soft latexes 20 and FIG. 1*b* depicts the case for case-hardened gel-g-soft latexes 26. In FIG. 1*a*, soft latex core 22, the chemically bonded gelatin layer 24 and in FIG. 1*b* to case-hardened gelatin layer 28. In each figure, the surfactant molecules 30 of this invention are attached to the gelatin layer. A theoretical concept of steric stabilization can be found in an article by Bagchi [*J. Colloid and Interface Science,* 47, 86(1974(].

An advantage of this invention is to achieve reduced pressure sensitivity of a photographic film product without creating defects arising out of agglomeration or flocculation of the gel-g-soft latex particles. This is achieved by the use of a specific type of surfactant in combination with the gel-g-soft latex particle in the specific layer in question.

A BRIEF DESCRIPTION OF THE DRAWINGS

FIG. 1*a* is a diagrammatic representation of gel-g-soft latex particles with surfactant in accordance with this invention.

FIG. 1*b* is a diagrammatic representation of case-hardened gel-g-soft latex particles with surfactant in accordance with this invention.

DESCRIPTION OF PREFERRED EMBODIMENTS

Figure 1A:
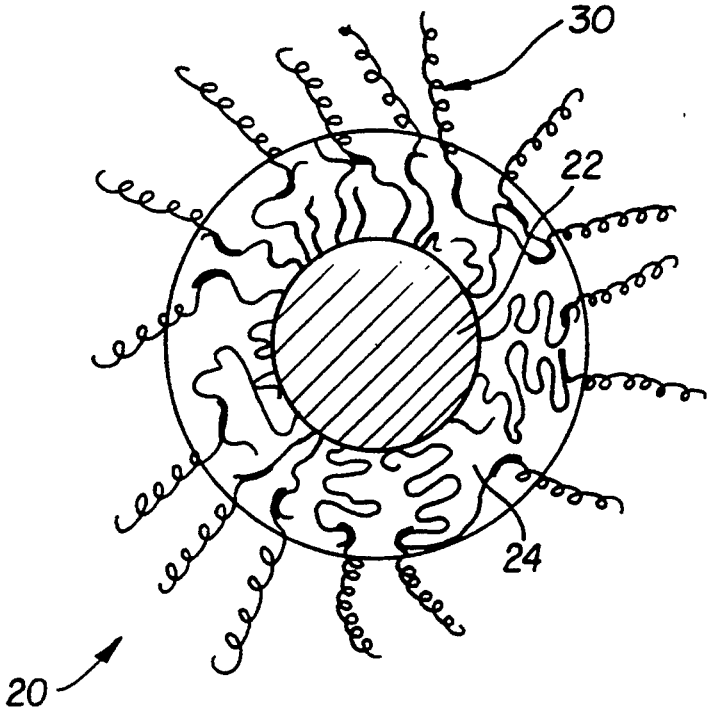
Figure 1B:
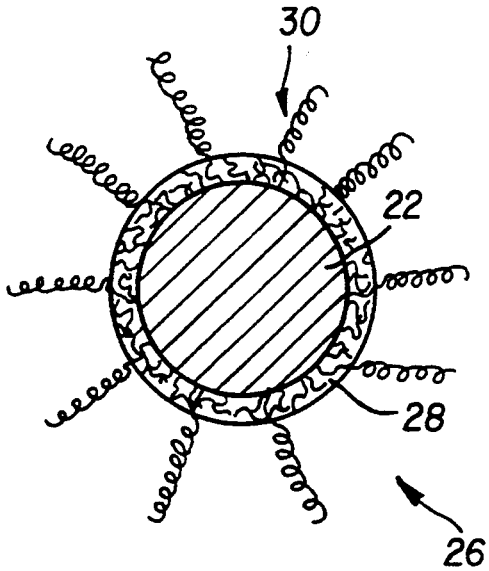

The polymer particles useful in the invention include particles that are covalently bonded to gelatin either directly or with the aid of a grafting agent (gel-g). The polymers are soft and deformable and preferably have a glass transition temperature of less than 25° C. Suitable polymer latex particles and methods of preparation are described in U.S. Pat. Nos. 4,855,219; 4,920,004; 5,026,632 and 5,066,572 incorporated herein by reference. These particles when hardened as in the preferred form of the invention provide significantly improved pressure resistance.

These materials can be made with just enough gelatin to cover the surface of the latex particles with very little or no gel left in solution. A preferred ratio of gelatin to the soft polymer particles is between 0.5–2. When further quantities of hardener are added, the hardener crosslinks the gelatin adsorption layer, as there is no free gelatin left in solution. This process may be called case-hardening. Such case-hardened gelatin-grafted soft latex particles are soft latex cores covered with a highly cross-linked hard thin skin around the core. In this composite particle, the hard shell, of up to 10 nm in thickness, is highly elastic and the core is soft and highly viscous. A dried coating containing these particles will exhibit viscoelastic behavior which means that it will absorb stress by deforming. However, this hardened elastic skin will relax back once stress is released, i.e., the composite particles will both absorb and resist mechanical stress (as the shock absorbers in an automobile) and will prevent substantial physical stress from being transmitted to the silver halide grains and thus produce relief from pressure sensitivity. The ,polymer particles have a chemically bonded layer of gelatin around them that sterically stabilizes the particles and thus prevents coalescence as may happen when high levels of soft polymer particles (without bonded gelatin shells around them) are incorporated in a photographic coating. Additional hardener added in the process of making the particles will cross-link the chemically bonded gelatin shell around the particles. This gelatin layer surrounding the particles will thus further cross-link with each other or with gelatin in a coating forming a stress absorbent layer in combination with silver halide crystals. The silver halide element may contain conventional color coupler dispersions prepared with or without coupler solvents. The invention also is suitable for use in films where the coupler is added with developing solutions.

DESCRIPTION OF GEL-G-SOFT LATEX INCLUDING CASE-HARDENED GEL-G-SOFT LATEX PARTICLES

As indicated in U.S. Pat. Nos. 5,026,632 and 5,066,572, gelatin-grafted-polymer particles are those where a polymer particle is surrounded by a mononuclear layer of gelatin that is chemically bonded to the particle surface. Further, case-hardened gelatin-grafted-polymer particles are gelatin-grafted-polymer particles in which the gelatin shell around a gelatin-grafted-polymer particle is further crosslinked to form a case-hardened shell around the polymer particles.

There are, in general, two ways of grafting gelatin to the surface of polymer particles. Firstly, this can be achieved by a dangling chemical moiety from the polymer surface that by itself can react with gelatin. Various chemistries that can be used to affect such bonding are extensively elucidated in U.S. Pat. Nos. 5,026,632 and 5,066,572. One of the preferred moieties for such bonding is chloromethyl styrene.

The second general method of bonding gelatin to the surface of polymer particles involves the reaction of a moiety in the polymer backbone on the particle surface that reacts with a chemical grafting agent that causes bonding between the surface moiety and a gelatin molecule. The various grafting agents that may be utilized in causing this type of grafting are described in U.S. Pat. Nos. 5,026,632 and 5,066,572. The preferred grafting agents are:

1. Carbamoylonium compounds
2. Dication ether compounds, and
3. Carbodiimide compounds.

Further crosslinking of the gelatin shell to obtain case-hardened gelatin-grafted-polymer particles can be achieved by any usable gelatin cross-linking agent as described in U.S. Pat. Nos. 5,066,572 and 5,026,632.

Polymer particles of this invention may be of any size and may be prepared by emulsion polymerization, suspension polymerization and by limited coalescence as described in U.S. Pat. Nos. 5,066,572 and 5,026,632. The preferred size range of the core polymer particles for this invention is between 20 nm and 400 nm and is usually prepared by emulsion polymerization.

Surfactants suitable for this invention are of the following types:

Type A—Surfactants comprising between a 6 to 22 carbon atom hydrophobic tail with one or more attached hydrophilic chains comprising at least 8 oxyethylene and/or glycidyl ether groups that may or may not be terminated with a negative charge such as a sulfate group. Examples of Type A surfactants are shown in Table A.

TABLE A

ID A-1
Name Olin 10G
Manufacturer Dixie
Molecular Weight 961
Structure

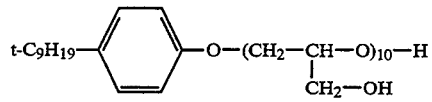

ID A-2
Name Polystep B-23
Manufacturer Stepan
Molecular Weight 817
Structure $$n\text{-}C_{12}H_{23}—O—(CH_2—CH_2—O)_{12}SO_3^-Na^-$$

ID A-3
Name Triton TX-102
Manufacturer Rohm & Haas
Molecular Weight 734
Structure

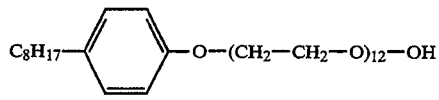

ID A-4
Name Tricol LAL-23
Manufacturer Emery
Molecular Weight 1198
Structure $$n\text{-}C_{12}H_{25}—O—(CH_2—CH_2—O)_{23}—OH$$

ID A-5

TABLE A-continued

Name Avanel S-150
Manufacturer PPG
Molecular Weight 976
Structure $$C_{12}H_{25}-O-(CH_2-CH_2-O)_{15}-\underset{\underset{Na^+SO_3^-}{|}}{CH_2}-CH_2$$

The most preferred surfactants of this class for this invention are A-1 and A-2, as these produce the greatest reduction of agglomeration in coating melts.

Type B—Block oligomeric surfactants comprising hydrophobic polyoxypropylene blocks A and hydrophilic polyoxyethylene blocks B joined in the manner of A—B—A, B—A—B, A—B, $(A—B)_n \equiv G \equiv (B—A)_n$, or $(B—A)_n \equiv G \equiv (A—B)_n$, where G is a connective organic moiety and n is between 1 and 3. Examples of such surfactants are shown in Table B.

TABLE B

ID B-1
Name Pluronic TM Polyols
Manufacturer BASF
Molecular Weight 1,000 to 14,000
Structure $$HO-(CH_2CH_2-O)_a-(\underset{\underset{CH_3}{|}}{CH}-CH_2-O)_b-H-(OCH_2-CH_2)_c$$

ID B-2
Name Pluronic TM-R Polyols
Manufacturer BASF
Molecular Weight 1,900 to 9,000
Structure $$HO-(\underset{\underset{CH_3}{|}}{CH}-CH_2-O)_a-(CH_2-CH_2-O)_b-H-(O-CH_2-\underset{\underset{CH_3}{|}}{CH})_c$$

ID B-3
Name Plurodot TM Polyols
Manufacturer BASF
Molecular Weight 3,200 to 7,500
Structure
Liquid Polyethers Based on Alkoxylated Triols ID B-4
Name Tetronic TM Polyols
Manufacturer BASF
Molecular Weight 3,200 to 27,000
Structure $$\begin{array}{l} HO-(CH_2CH_2-O)_y-(\underset{\underset{CH_3}{|}}{CH}-CH_2-O)_x \\ \qquad\qquad\qquad\qquad\qquad\qquad\qquad\qquad N-CH_2- \\ HO-(CH_2CH_2-O)_y-(\underset{\underset{CH_3}{|}}{CH}-CH_2-O)_x \\ HO-(CH_2CH_2-O)_y-(\underset{\underset{CH_3}{|}}{CH}-CH_2-O)_x \\ \qquad\qquad\qquad\qquad\qquad\qquad\qquad\qquad N-CH_2- \\ HO-(CH_2CH_2-O)_y-(\underset{\underset{CH_3}{|}}{CH}-CH_2-O)_x \end{array}$$

ID B-5
Name Pluracol TM E
Manufacturer BASF
Molecular Weight 200 to 45,000
Structure $$HO-(CH_2-CH_2-O)_y-H$$

ID B-6

TABLE B-continued

Name Pluracol TM P
Manufacturer BASF
Molecular Weight 400 to 2,000
Structure $$HO-(CH_2-\underset{\underset{CH_3}{|}}{CH_2}-O)_y-H$$

ID B-7
Name —
Manufacturer —
Structure
General Formula $$CH_3CH_2-O-\begin{cases} CH_2O(\overset{\overset{CH_3}{|}}{C}HCH_2O)_a(CH_2CH_2O)_oH \\ CH_2O(\overset{\overset{CH_3}{|}}{C}HCH_2O)_b(CH_2CH_2O)_pH \\ CH_2O(\overset{\overset{CH_3}{|}}{C}HOH_2O)_c(CH_2CH_2O)_qH \end{cases}$$

Compound (P-7a) (a + b + c):(o + p + q) = 1:0.43
Compound (P-7b) (a + b + c):(o + p + q) = 1:0.25
Compound (P-7c) (a + b + c):(o + p + q) = 1:0.10

| Molecular Weight Entire Polyoxypropylene | |
|---|---|
| Cmpd | Fragment |
| 4500 | 3400 |
| 4000 | 3400 |
| 4000 | 3700 |

ID B-8
Name —
Manufacturer —
Structure
General Formula $$H-C-\begin{cases} CH_2O(\overset{\overset{CH_3}{|}}{C}HCH_2O)_a(CH_2CH_2O)_oH \\ O(\overset{\overset{CH_3}{|}}{C}HCH_2O)_b(CH_2CH_2O)_pH \\ CH_2O(\overset{\overset{CH_3}{|}}{C}HOH_2O)_c(CH_2CH_2O)_qH \end{cases}$$

Compound (P-8a) (a + b + c):(o + p + q) = 1:0.3
Compound (P-8b) (a + b + c):(o + p + q) = 1:0.2

| Molecular Weight Entire Polyoxypropylene | |
|---|---|
| Cmpd | Fragment |
| 3000 | 2400 |
| 1500 | 1300 |

ID B-9
Name —
Manufacturer —
Structure $$\begin{array}{l} CH_2O(\overset{\overset{CH_3}{|}}{C}HCH_2O)_a(CH_2CH_2O)_oH \\ H-C-O(\overset{\overset{CH_3}{|}}{C}HCH_2O)_b(CH_2CH_2O)_pH \\ H-C-O(\overset{\overset{CH_3}{|}}{C}HCH_2O)_c(CH_2CH_2O)_qH \\ H-C-O(\overset{\overset{CH_3}{|}}{C}HCH_2O)_d(CH_2CH_2))_rH \\ H-C-O(\overset{\overset{CH_3}{|}}{C}HCH_2O)_e(CH_2CH_2O)_sH \\ CH_2O(\overset{\overset{CH_3}{|}}{C}HCH_2O)_f(CH_2CH_2O)_tH \end{array}$$

Compound (P-9a) (a + b + c + d + e + f):(o + p + q + r + s + t) = 1:0.5
Compound (P-9b) (a + b + c + d + e + f):(o + p + q + r + s + t) = 1:0.3

TABLE B-continued

Compound (P-9c) (a + b + c + d + e + f):(o + p + q + r + s + t) = 1:0.1

| Molecular Weight Entire Polyoxypropylene | |
|---|---|
| Cmpd | Fragment |
| 3000 | 2200 |
| 1000 | 300 |
| 1000 | 900 |

The preferred surfactants of Type B for this invention are those which have at least 1–5 times more polyoxyethylene groups compared to the polyoxypropylene groups. The most preferred surfactant is Pluronic L-44 of Type B-1, where a>>C>>10; b>>20; and molecular weight is about 2,200.

Type C: Sugar surfactants, comprising between one and three 6 to 22 carbon atom hydrophobic tails with one or more attached hydrophilic mono, di, tri or oligosaccharidic chains that may or may not be terminated by a negatively charged group such as a sulfate group. Examples of such surfactants are shown in Table C.

TABLE C

Example of Surfactants of This Invention That Belong to Type C

C-1

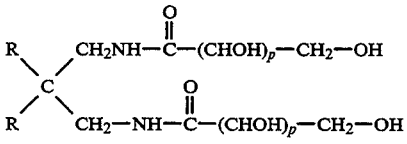

where R = n-$CH_3$—$(CH_2)_x$ (where x = 3 to 10)

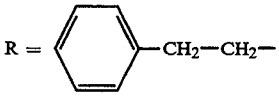

P = 3 to 10

C-2

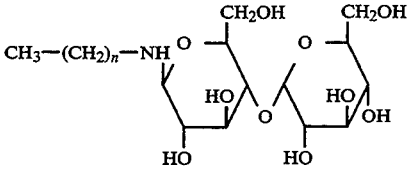

where, n = 3 to 15

C-3

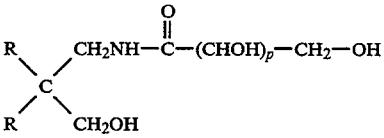

where R = n-$CH_3$—$(CH_2)_x$ (where X = 3 to 10)

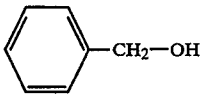

P = 3 to 15

C-4

TABLE C-continued

Example of Surfactants of This Invention That Belong to Type C

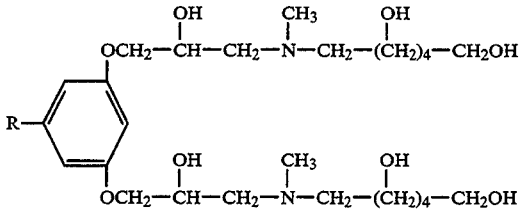

where, R = n-$CH_3$—$CH_2)_x$—
(where, x = 1 to 5)

C-5

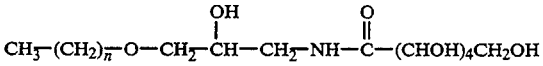

where, n = 3 to 15

C-6

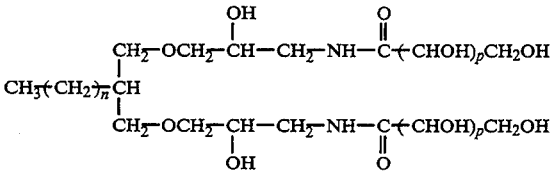

where, n = 2 to 12
p = 3 to 10

C-7

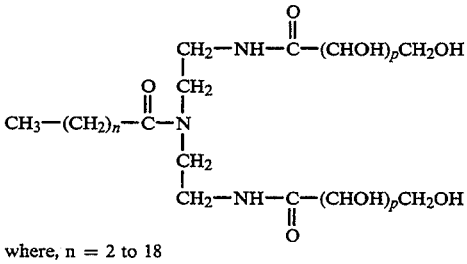

where, n = 2 to 18
p = 3 to 10

C-8

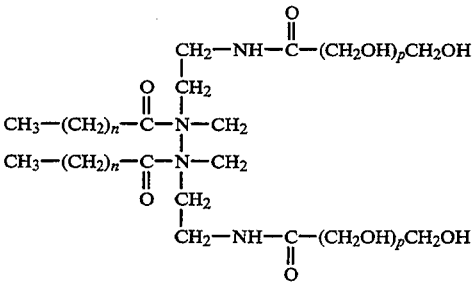

where, n = 2 to 18
p = 3 to 10

C-9

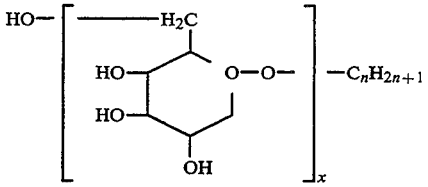

TABLE C-continued

| Example of Surfactants of This Invention That Belong to Type C |
|---|
| C-10 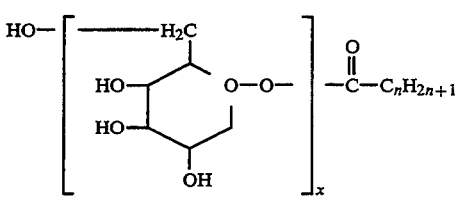 |
| where in the two formulas immediately above, n = 5 to 20 and x = 1 to 4. |

The sugar surfactants of Type-C are the most preferred among the three types of surfactants of this invention and the most preferred Type-C surfactant for this invention is C-9.

EXAMPLES

The following examples are intended to be illustrative and not exhaustive of the invention. Parts and percentages are by weight unless otherwise mentioned. Coating laydowns are given in "mg/ft$^2$". Multiplication of these numbers by 10.7 will convert them to "mg/m$^2$". In some cases the "g/m$^2$" numbers are also included within parentheses "()".

Examples 1 through 5: Preparation of Core Latex Particles

These examples describe the general method of preparation of the core latex particles for the gel-g-latex particles. Table I describes the components of these latex particles.

TABLE I

| Latex Preparation | | | | |
|---|---|---|---|---|
| | Monomer (weight, g) | | | |
| Example | A Butyl Acrylate | B Methyl Metha-crylate | C Methacrylic Acid | Nitrogen Purged Water g |
| 1 | 360 | 0 | 20 | 4000 |
| 2 | 380 | 0 | 20 | 4000 |
| 3 | 360 | 0 | 40 | 4000 |
| 4 | 180 | 180 | 40 | 4000 |
| 5 | 0 | 360 | 40 | 4000 |

A total of 400 g of monomer is used to prepare these latexes.

All latex preparations are carried out in the following manner. A 5 liter three neck round bottom flask is filled with 4 liter of nitrogen purged distilled water and set up with a stirrer and a condenser in a constant temperature bath at 60° C. To the flask are added 8 g sodium dodecyl sulfate, 8 g of $K_2S_2O_8$ and 4 g $Na_2S_2O_5$ and reacted at 60° C. for 17 hrs. after addition of the monomers as indicated in Table I. The latex is filtered though glass wool. Conversion is about 98%. The latex samples prepared are designated with example numbers and set forth in Table I. In each batch about 400 g of polymer are prepared.

Examples 6 through 10: Preparation of Case-Hardened Gelatin-Grafted and Gelatin-Grafted Polymer Particles Samples of case-hardened gelatin-grafted polymer particles prepared in accordance with Examples 16 and 17 and gelatin-grafted polymer particles in accordance with Example 14 of U.S. Pat. No. 5,026,632 are employed in these Examples 6–10. A general method of preparation of the samples used is given as follows.

The prepared latex sample of Examples 1 through 5 are individually placed in a three neck 12 liter round bottom flask. The flask is placed in a constant temperature bath and heated to 60° C. The pH is adjusted to 8.0. This material, as indicated earlier, consists of about 400 g of polymer. The grafting agent used as before (U.S. Pat. No. 5,026,632) is compound A. It is used to the extent of 0.2 mils per mole of Compound A

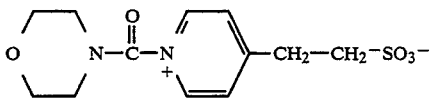

surface methacrylic acid, which is taken to be 5% of the polymer by weight. Therefore, $(400\times0.05\times0.2\times300)86=14.0$ g of compound A (where 300 is the molecular weight of compound A and 86 is the molecular weight of methacrylic acid) are dissolve in 140 g of distilled water and added to the latex in the flask at 60° C. under stirring. The flask is fitted with a condenser. Reaction is allowed to continue for 20 minutes. In all cases the amount of gelatin used is 50% based upon polymer weight, i.e., $400\times50$ g=200 g. 200 g of dry gelatin are dissolved in 2,000 g of distilled water and heated to 60° C. The pH is adjusted to 8.0 using NaOH. The gelatin solution is added to the reaction vessel and grafting and case-hardening reaction carried out for twenty minutes at 60° C. The gelatin used was a lime processed ossein gelatin.

The inventive sample is combined with the sugar surfactant (C-9), wherein n=8 to 10 and x=1.8 (APG 225 manufactured by Henkel Corporation) to eliminate formation of particulates in the finished coatings. The amount added is 0.2 g of the surfactant for a 70% active solution, per g of the latex polymer. The appropriate amount of the surfactant is added and mixed in the reaction at 60° C. for 30 minutes.

The prepared samples are listed in Table II. All samples have final solids of about 9.5% (ID.1%), and all samples have 2 part latex 1 part gelatin in 33% gelatin. It is to be noted that samples of Examples 10 and 13 are mixtures of two types of case-hardened gel-g-latex samples. Poly(butyl acrylate) has a glass transition temperature Tg of about −5° C. [J. Brandrup and E. H. Immergut, "Polymer Handbook", Wiley-Interscience, New York (1975)]. Therefore, at ambient temperatures it is soft and rubbery. Poly(methyl methacrylate) has a Tg value greater than 100° C. and at ambient temperatures, it is hard and glassy. Therefore, butyl acrylates rich samples are expected to show greater pressure sensitivity relief.

Table II

| Case-Hardened Gel-g-Latex Samples | |
|---|---|
| Example | Description |
| 6 (Control) | C—H Gel-g-AC (95/5) [33% Gel] |
| 7 (Inventive) | C—H Gel-g-AC (95/5) [33% Gel] + surfactant C-9 |
| 8 (Inventive) | C—H Gel-g-AC (90/10) [33% Gel] + surfactant C-9 |
| 9 (Inventive) | C—H Gel-g-BC (90/10) [33% Gel] + surfactant C-9 |
| 10 (Inventive) | 50% CH Gel-g-AC (90/10) [33% Gel] + |

Table II-continued

| Example | Case-Hardened Gel-g-Latex Samples Description |
|---|---|
| | surfactant C-9 |
| | 50% CH Gel-g-BC (90/10) [33% Gel] + surfactant C-9 |
| 11 (Inventive) | CH Gel-g-ABC (45/45/10) [33% Gel] + surfactant C-9 |
| 12 (Inventive) | C—H Gel-g-AC (90/10) [33% Gel] + surfactant C-9 |
| 13 (Inventive) | 22% C-H Gel-g-AC (90/10) [33% Gel] + surfactant C-9 |
| | 78% CH Gel-g-BC (90/10) [33% Gel) + surfactant C-9 |

Figure 2:
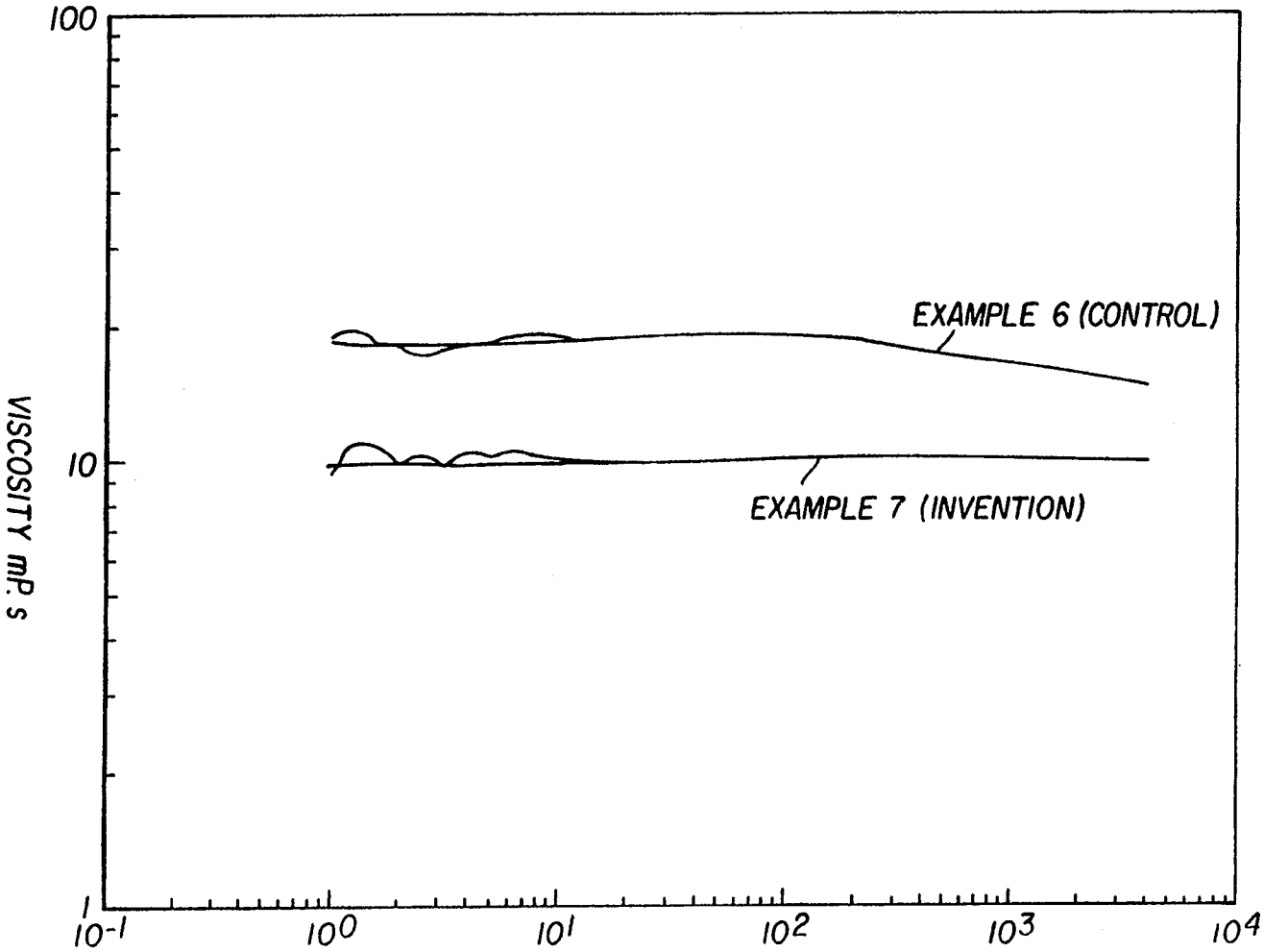
FIG. 2 are rheograms of CH gel-g-latex samples of Examples 6 (no surfactant) and 7 (surfactant).

Note: Surfactant C-9 is present at the level of 0.2 g per g of latex polymer. A usable range is between 0.05 g to 0.6 g of C-9 per g of latex polymer FIG. 2 shows rheograms of CH gel-g-latex melts of Examples 6 (control) and 7 (inventive). Use of such sugar surfactant lowers the viscosity of the CH gel-g-latex samples from about 20 mP.s to 10 mP.s at 100 $Sec^{-1}$ and also seems to eliminate shear thinning behavior (Example 7). The superimposed curves are samples held for 3 weeks. It is seen that the rheological behavior of the samples were invariant in that time span. The rheograms are measured using a Rheometrics rheogoneometer.

Examples 11–20: Photographic Evaluation

All photographic evaluations are carried out using a color negative film format as described hereafter.

A cellulose triacetate film support having an antihalation layer on one side and an antistatic layer on the other is coated on the antihalation layer with the following layers in sequence (coverages are in grams per meter squared):

Slow Cyan Dye-Forming Layer

This layer comprises a blend of red-sensitized, cubic, silver bromoiodide emulsion (1.5 mol percent iodide) (0.31 um grain size) (1.16 and red-sensitized, tabular grain, silver bromoiodide emulsion (3 mol percent iodide) (0.75 um diameter by 0.14 um thick) (1.31), Compound J (0.965), Compound F (0.011), Compound L (0.65) and gelatin (2.96).

Fast Cyan Dye-Forming Layer

This layer comprises a red-sensitized, tabular grain silver bromoiodide emulsion (6 mol percent iodide) having a diameter of 1.40 um and a thickness of 0.12 um (0.807), Compound J (0.102), Compound K (0.065), Compound L (0.102) and gelatin (1.506).

Interlayer

This layer comprises Compound F (0.054), an antifoggant and gelatin (1.291).

Slow Magenta Dye-Forming Layer

This layer comprises a blend of green-sensitized tabular grain silver bromoiodide emulsion (3 mol percent iodide) (grain diameter 0.55 um and thickness 0.08 um) (0.473) and tabular grain silver bromoiodide emulsion (3 mol percent iodide) (grain diameter 0.52 and thickness 0.09 um) (0.495), Compound G (0.161), Compound I (0.108) and gelatin (2.916).

Fast Magenta Dye-Forming Layer

This layer comprises a blend of green-sensitized tabular grain silver bromoiodide emulsion (3 mol percent iodide) (grain diameter 1.05 um and thickness 0.12 um) (0.536) and tabular grain silver bromoiodide emulsion (3 mol percent iodide) (grain diameter 0.75 um and thickness 0.14 um), Compound G (0.258), Compound H (0.054) and gelatin (1.119).

Interlayer

This layer comprises Carey-Lea Silver (0.43), Compound F (0.054), an antifoggant and gelatin (0.861).

Slow Yellow Dye-Forming Layer

This layer comprises a blend of blue-sensitized tabular grain silver bromoiodide emulsion (3 mol percent iodide) (grain diameter 0.57 mm and thickness 0.12 mm) (0.274) and blue-sensitive silver bromoiodide emulsion (0.3 mol percent iodide) (grain diameter 0.52 and thickness 0.09 mm) (0.118), Compound C (1.022), Compound D (0.168) and gelatin (1.732).

Fast Yellow Dye-Forming Layer

This layer comprises a blue-sensitized tabular grain silver bromoiodide emulsion (3 mol percent iodide) (grain diameter 1.10 mm and thickness 0.12 mm) (0.43), Compound C (0.161), Compound D (0.054), Compound E(0.003) and gelatin (1.119).

UV Absorbing Layer

This layer comprises silver halide Lippmann emulsion (0.215), Compound A (0.108), Compound B (0.106) and gelatin (0.538). This layer also contained the invention CH gel-g-latex samples (0.214 or 0.428) except in the case of the control.

Overcoat

This layer comprises polyvinyl toluene matte particles (0.038) and gelatin (0.888). One control example contained Ludox TM (0.289).

The thus prepared photographic film is perforated in 35 mm format, exposed in a 35 mm camera and processed in a standard photofinishing processor. The processed film is printed in a standard photofinishing, high speed printer.

The structures of the above-designated Compounds A through L are as follows:

A:

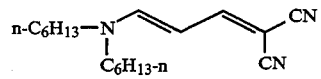

B:

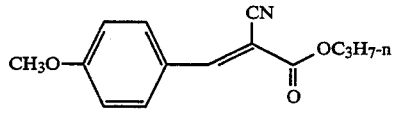

C:

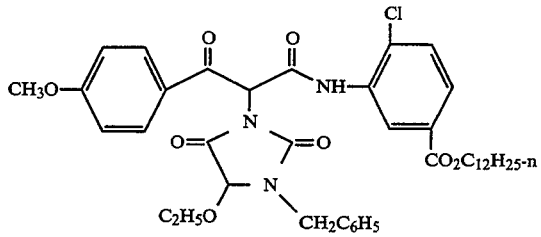

-continued
D:
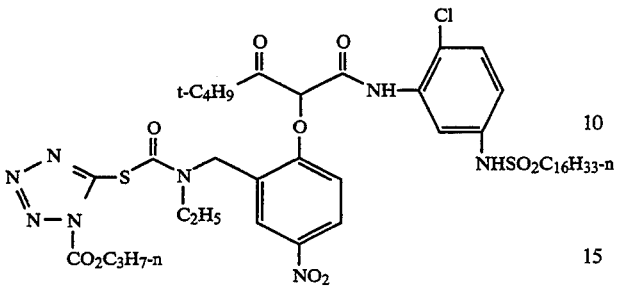
E:
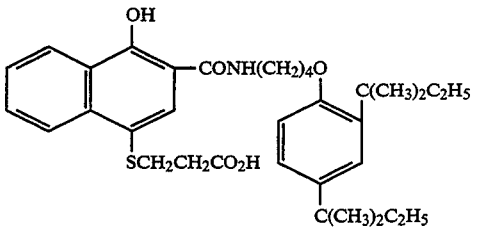
F:
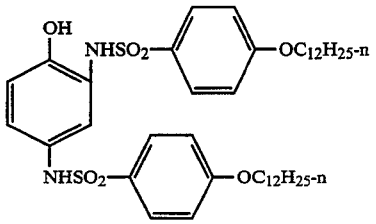
G:
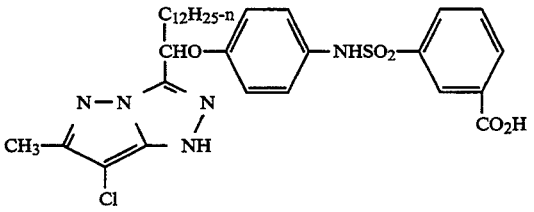
H:
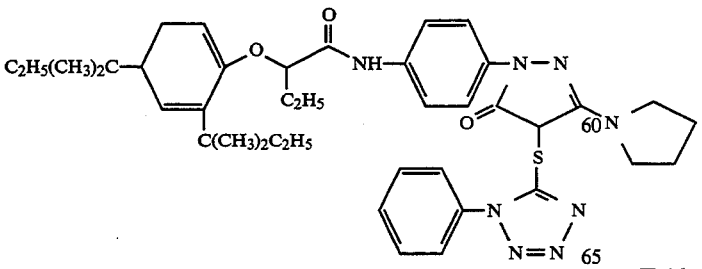
I:
-continued
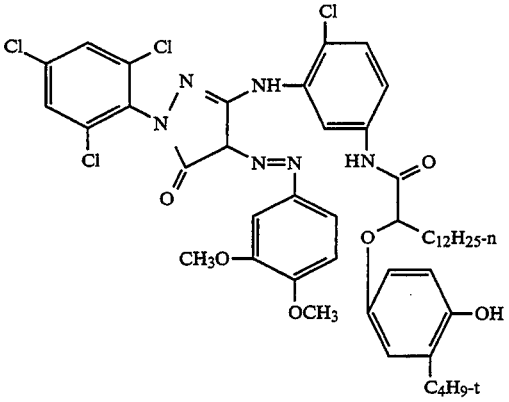
J:
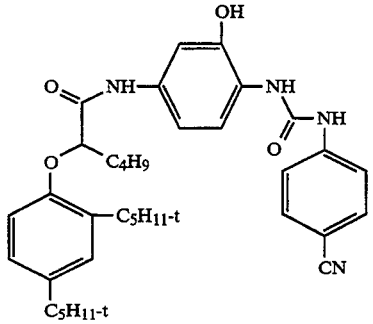
K:
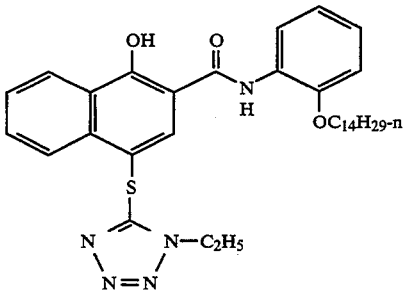
L:
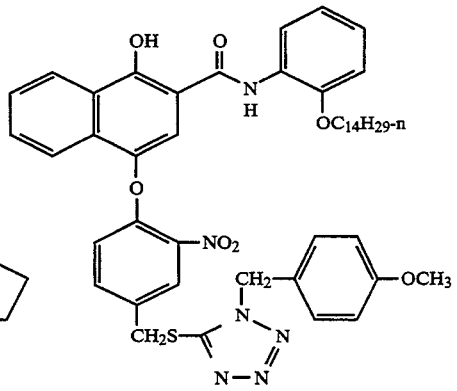
Table III provides a list of the descriptions of the coating set utilized in this invention.

TABLE III

| Example # | Coating Set: UV Absorbing Layer Comprising | Coating Set: Overcoat Layer Comprising |
|---|---|---|
| 11 (Control) | Standard | Standard |
| 12 (Control) | Standard | Ludox |
| 13 (Control) | C—H Gel-g-latex of Example 6 with no surfactant | Standard |
| 14 (Inventive) | C—H Gel-g-latex of Example 7 with C-9 | Standard |
| 15 (Inventive) | C—H Gel-g-latex of Example 8 with C-9 | Standard |
| 16 (Inventive) | C—H Gel-g-latex of Example 9 with C-9 | Standard |
| 17 (Inventive) | C—H Gel-g-latex of Example 10 with C-9 | Standard |
| 18 (Inventive) | C—H Gel-g-latex of Example 11 with C-9 | Standard |
| 19 (Inventive) | C—H Gel-g-latex of Example 12 with C-9 | Standard |
| 20 (Inventive) | C—H Gel-g-latex of Example 13 with C-9 | Standard |

Ludox is colloidal silica sold by DuPont

Figure 3:
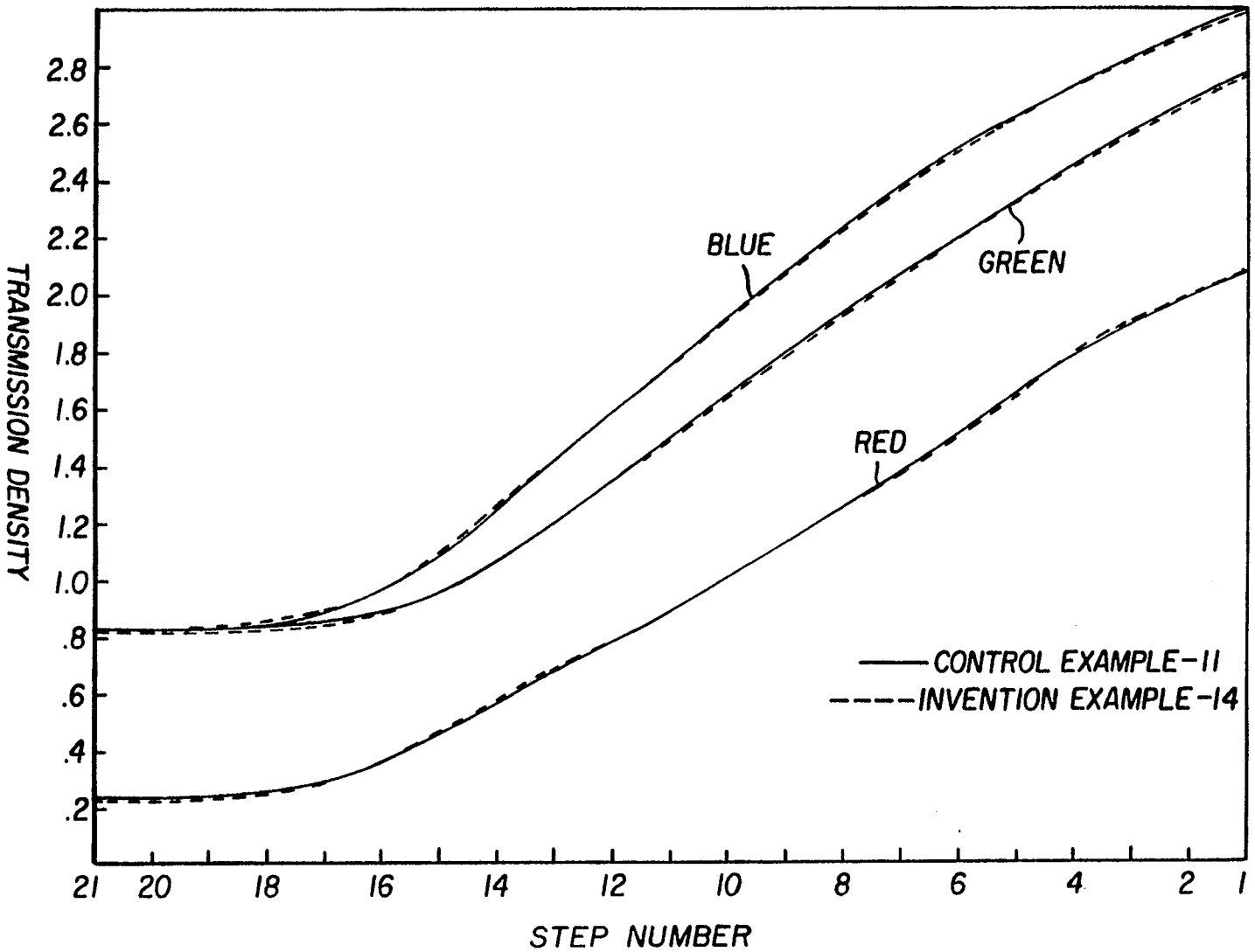
FIG. 3 is a comparison of sensitometry of Control Example 11 and inventive coating of Example 4.

All coatings of the set of Table III are exposed to an illuminating source through a standard stepwedge and developed by the standard C41 processing. All resulting sensitometries were virtually identical to each other within experimental variability indicating that the CH gel-g-latex samples has no adverse photographic effect. This is illustrated in FIG. 3, showing the red, green, and blue image densities.

Figure 4:
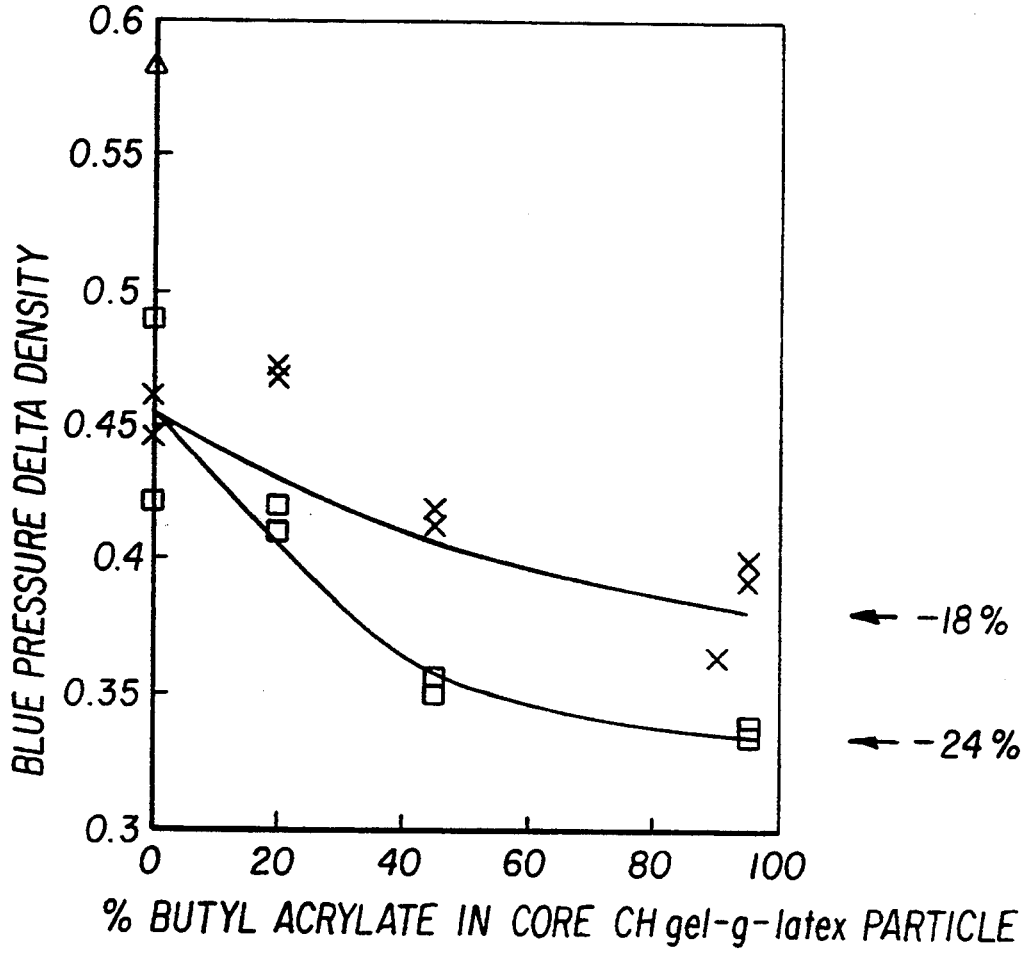
FIG. 4 illustrates the pressure sensitivity of the coated inventive compositions with their controls as indicated in Table III.

Next, in order to determine the effect of pressure on the resulting coatings, a second set of unexposed strips are first passed under a rough roller at 42.0 lb per sq inch (or 289.6 kPa), then exposed similarly, processed by C41 process and then red, green, and blue densities are measured as in the previous samples. The difference in densities of the pressured and unpressured samples provide the pressure sensitivity data reported in FIG. 4. The blue sensitive layer being at the upper layers of the coatings, the effect of pressure is greater in this layer. Therefore, only blue pressure sensitivity data are reported. FIG. 4 shows the measured blue pressure sensitivity data as a function of butylacrylate (soft component) content of the CH gel-g-latexes at the two coverages. It is clear from this data that:

Increase of the butylacrylate content of the CH gel-g-latexes (in the soft component) increases the extent of pressure sensitivity relief.

Increase in laydown of the CH gel-g-soft latex increases the pressure sensitivity relief of the coatings.

Incorporation of Ludox TM (for tougher overcoats) increases the pressure sensitivity of the coatings.

In the above, soft latexes are those latexes that have glass transition temperatures (Tg) lower than room temperature, i.e., about 23° C.

The major observation of this invention is that control coating of Example 3 with CH gel-g-latex and no surfactant added showed traces of defects in the coatings due to aggregation of the particles. However, all coatings in accordance with the invention show no defects due to particle aggregation in the coatings.

The invention has been described in detail with particular reference to preferred embodiments thereof, but it will be understood that variations and modifications can be effected within the spirit and scope of the invention.

We claim:

1. A multilayer photographic element comprising at least one light sensitive silver halide containing layer, an overcoat layer containing colloidal silica and a cushioning layer which comprises composite particles having a polymer core having a mean diameter of from about 10 to 500 nm covalently bonded to a gelatin shell, and a surfactant selected from A. an amphiphilic surfactant selected from the group consisting of a 6 to 22 carbon atom hydrophobic tail with one or more attached hydrophilic chains comprising at least 8 oxyethylene and/or glycidyl ether groups that may or may not be terminated with a negative charge such as a sulfate group, and B. a block oligomeric surfactant selected from the group consisting of hydrophobic polyoxypropylene blocks (A) and hydrophilic polyoxyethylene blocks (B) joined in the manner of A—B—A, B—A—B, A—B $(A—B)_n oGo(B—A)_n$, or $(B—A)_n oGo(A—B)_n$, where G is a connective organic moiety and n is between 1 and 3, and C. a sugar surfactant selected from the group consisting of between one and three 6 to 22 carbon atom hydrophobic tail with one or more attached hydrophioic mono or oligosaccharidic hydrophilic chains that may or may not be termianted by a negatively charged group such as a sulfate group or mixtures thereof.

2. The multilayer photographic element of claim 1 wherein the soft polymer core has a glass transition temperature less than 23° C.

3. The multilayer photographic element of claim 1 wherein the surfactant is A.

4. The multilayer photographic element of claim 1 wherein the surfactant is B.

5. The multilayer photographic element of claim 1 wherein the surfactant is C.

6. The multilayer photographic element of claim 1 wherein the composite particle is a gel-grafted latex particle.

7. The multilayer photographic element of claim 1 wherein the gel-grafted latex particle is case-hardened.

8. The multilayer photographic element of claim 1 wherein the surfactant is present in an amount of from about 0.05 g to 0.6 g per gram of the polymer core.

9. The multilayer photographic element of claim 1 wherein the polymer core is butyl acrylate.

10. The multilayer photographic element of claim 5 wherein the surfactant is selected from the group consisting of

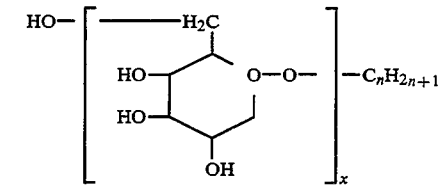

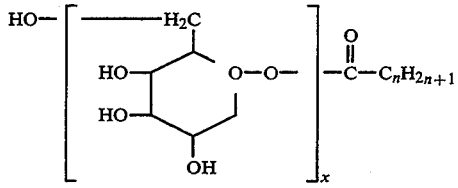

where in the two formulas immediately above,
n=5 to 20 and
x=1 to 4.

* * * * *